US005612537A

United States Patent [19]

Maynard et al.

[11] Patent Number: 5,612,537

[45] Date of Patent: Mar. 18, 1997

[54] DETECTING THE PRESENCE OF A FIRE

[75] Inventors: Steven P. Maynard, London; Paul J. Basham, High Wycombe; Mark E. Pleydell, West Drayton, all of Great Britain

[73] Assignee: Thorn Security Limited, Middlesex, England

[21] Appl. No.: 298,307

[22] Filed: Sep. 1, 1994

[30] Foreign Application Priority Data

Sep. 3, 1993 [GB] United Kingdom ..... 9318284

[51] Int. Cl.[6] ..... G08B 17/12

[52] U.S. Cl. ..... 250/339.15

[58] Field of Search ..... 250/339.15

[56] References Cited

U.S. PATENT DOCUMENTS 4,553,031 11/1985 Cholin et al. .

5,373,159 12/1994 Goldenberg et al. ..... 250/339.15

*Primary Examiner*—Constantine Hannaher

*Attorney, Agent, or Firm*—Keck, Mahin & Cate

[57] ABSTRACT

Apparatus for detecting the presence of a fire includes a pair of detectors for radiation characteristic of a fire, e.g. at 4.3 microns, and a further detector for radiation characteristic of a black body, e.g. at 3.8 microns. Filters select the detector output components at flame flicker frequencies. The filtered outputs of the detector pair are cross-correlated to produce a relatively noise-free signal. This signal is divided by a factor obtained by cross-correlating the further detector filtered output with the average of the detector pair filtered outputs. The result of the division is applied to a threshold-responsive circuit. Thus the relatively noise-free signal is effectively subjected to a threshold which is proportional to the degree of similarity between the variations with time of the output signal of the further detector and the output signals of the detector pair.

10 Claims, 1 Drawing Sheet

DETECTING THE PRESENCE OF A FIRE

Figure 1:
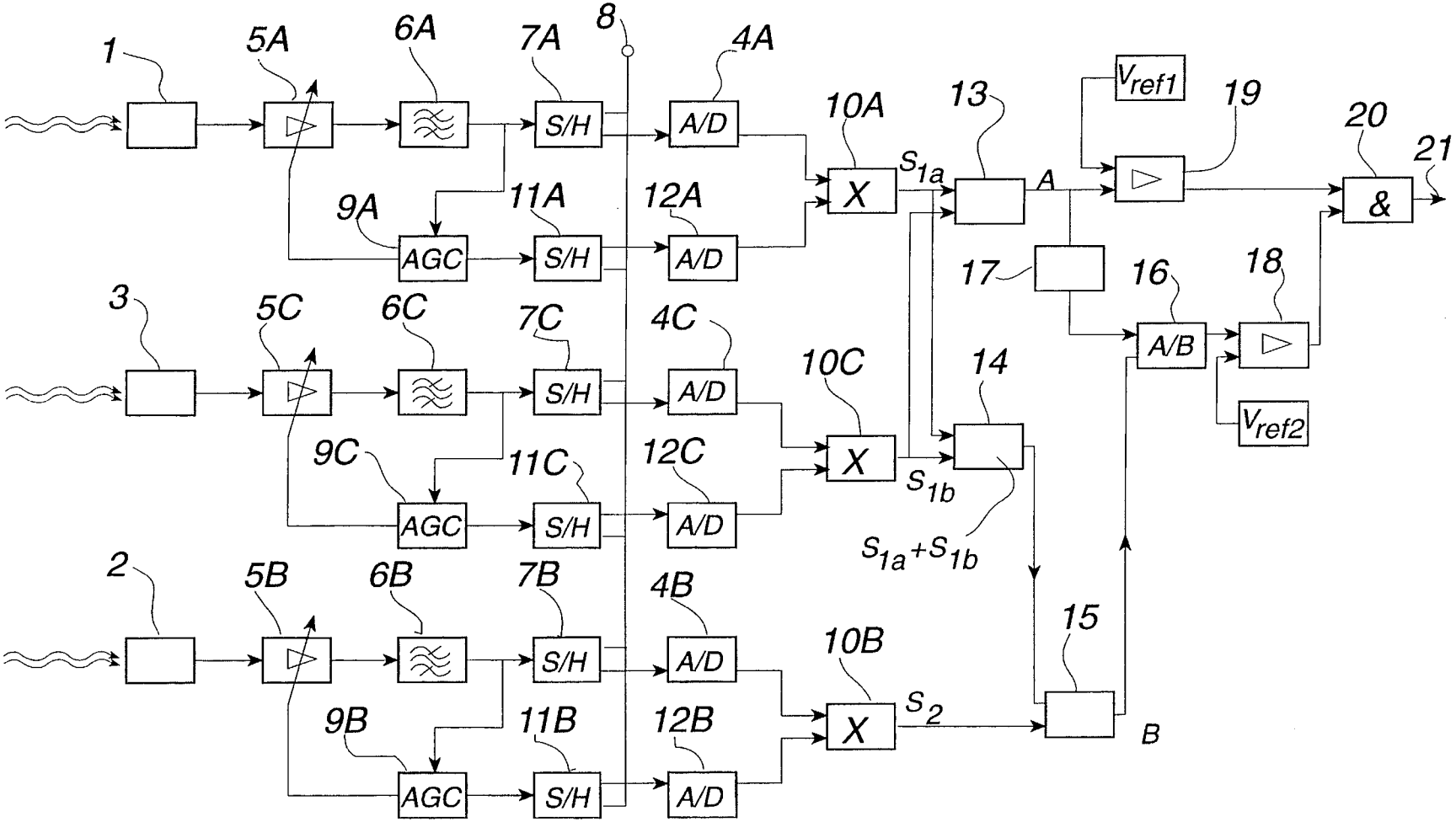

This invention relates to a method of detecting the presence of a fire, comprising determining whether a quantity derived from the output of a first detector for radiation within a spectral band which includes a wavelength characteristic of a fire exceeds a threshold which is varied in dependence upon the output signal of a second detector for radiation within a spectral band of wavelengths characteristic of black body radiation.

The invention also relates to apparatus for implementing such a method.

A known method and apparatus of this kind is disclosed in U.S. Pat. No. 4,553,031. In this known method and apparatus the first detector detects within a narrow spectral band centered on 4.3 microns and the second detector detects within a narrow spectral band centered on 3.8 microns. 4.3 microns is a resonance wavelength at which excited carbon dioxide (a normal combustion product) radiates strongly, whereas 3.8 microns is a wavelength at which significant such resonance radiation does not normally occur from any combustion product. The presence of a fire is indicated inter alia if the rectified a.c. component of the output signal of the first detector exceeds the rectified a.c. component of the output signal of the second detector by 10% or more. Thus, in effect, significant deviations at 4.3 microns from the normal black body radiation curve are detected. This can provide reasonable fire detection sensitivity with less likelihood of false alarms occurring than if the rectified a.c. component of the output signal of the first detector were simply compared with a fixed threshold. However further improvement in this respect is desirable and it is an object of the present invention to enable this to be achieved.

According to one aspect of the present invention a method as defined in the first paragraph is characterized in that the threshold is varied in accordance with the degree of similarity between variation with time of the output signal of the second detector and variation with time of the output signal of a detector for radiation within a spectral band which includes a wavelength characteristic of a fire in such manner that the threshold is increased with increasing similarity and decreased with decreasing similarity.

Varying the threshold in accordance with the degree of similarity between variation with time of the output signal of the second detector and variation with time of the output signal of a detector (conveniently but not necessarily constituted by the first detector) for radiation within a spectral band which includes a wavelength characteristic of a fire in such manner that the threshold is increased with increasing similarity and decreased with decreasing similarity can give improved sensitivity and/or less susceptibility to false alarms as compared with simply making the threshold directly proportional to the a.c. component of the output signal of the second detector.

Preferably the degree of similarity is determined by cross-correlating a.c. components of the two output signals. However other methods such as comparing the positions of the turning points, or the positions of the zero-crossings of a.c. components, or the frequency contents, of the two output signals may alternatively be employed, if desired. If a.c. components of the two output signals are used these are preferably those which lie within a frequency band corresponding to flame flicker frequencies.

The detection of the exceeding of the threshold is conveniently achieved by comparing with a reference value the quotient of said quantity and a second quantity which is dependent on said degree of similarity, in which case the first-mentioned quantity is preferably the amount by which a signal derived from the output of the first detector exceeds a non-zero value. However other methods are also possible, for example direct comparison of the two quantities with each other or comparison of their difference with a reference value.

The first-mentioned quantity is preferably itself derived from the output of the first detector via a behaviour similarity determination process which is such as to increase the value of this quantity the greater the similarity is between variation with time of the output signal of the first detector and variation with time of the output signal of another detector for radiation within a spectral band which includes a wavelength characteristic of a fire, and conversely. If this is the case improved immunity to the effects of noise can result. Said first detector and said another detector (if present) preferably but not necessarily each detect radiation within a spectral band which includes the same wavelength characteristic of a fire.

Preferably a signal indicative of the presence of a fire is generated if the first-mentioned quantity exceeds both said threshold and a further fixed threshold. In this way it can be ensured that the first-mentioned quantity arises from a valid detector output signal rather than from noise.

According to another aspect the invention provides fire detection apparatus comprising a first detector for radiation within a spectral band which includes a wavelength characteristic of a fire, a second detector for a spectral band of wavelengths characteristic of black body radiation, and a signal processor arranged to determine whether a quantity derived from the output of the first detector exceeds a threshold and to vary said threshold in dependence upon the output signal of the second detector, characterized in that the signal processor is arranged to vary the threshold in accordance with the degree of similarity between variation with time of the output signal of the second detector and variation with time of the output signal of a detector for radiation within a spectral band which includes a wavelength characteristic of a fire in such manner that the threshold is increased with increasing similarity and decreased with decreasing similarity.

An embodiment of the invention will now be described, by way of example, with reference to the accompanying diagrammatic drawing the single FIGURE of which is a block diagram of a fire detection apparatus.

In the drawing fire detection apparatus comprises a first detector 1 for radiation within a spectral band which includes a wavelength characteristic of a fire, a second detector 2 for radiation within a spectral band of wavelengths characteristic of black body radiation, and another detector 3 for radiation within a spectral band which includes a wavelength characteristic of a fire. The detectors 1, 2 and 3 are given the required spectral responses by means of respective optical interference filters (not shown). In the present example the detectors 1 and 3 are each responsive to a narrow spectral band centered on 4.3 microns, i.e. a wavelength at which resonance radiation occurs from excited carbon dioxide, a common combustion product, and detector 2 is responsive to a narrow spectral band centered on 3.8 microns, i.e. a wavelength at which significant resonance radiation does not normally occur from any combustion product.

The output signals from the detectors 1, 2 and 3 are applied to the inputs of analogue-to-digital converters 4A, 4B and 4C respectively via variable-gain amplifiers 5A, 5B and 5C respectively, band-pass filters 6A, 6B and 6C respectively, and sample-and-hold circuits 7A, 7B and 7C respectively. The band-pass filters 6 each have a pass-band corresponding to flame flicker frequencies, for example 1 Hz to 15 Hz. The sample-and-hold circuits 7 are controlled by clock pulses applied to an input 8. The gains of the amplifiers 5A, 5B and 5C are adjusted by means of gain control signal generator circuits 9A, 9B and 9C respectively which are responsive to the amplitudes of the output signals of the filters 6A, 6B and 6C respectively. Output signals of the gain control signal generator circuits 9A, 9B and 9C (representative of the gains of the amplifiers 5A, 5B and 5C respectively) are fed to one input of digital multipliers 10A, 10B and 10C respectively via sample-and-hold circuits 11A, 11B and 11C respectively and analogue-to-digital converters 12A, 12B and 12C respectively. The other inputs of the multipliers 10A, 10B and 10C are fed with the output signals of the converters 4A, 4B and 4C respectively so that these multipliers generate output quantities $S_{1a}$, $S_2$ and $S_{1b}$ respectively which are representative of the true instantaneous amplitudes of those components of the output signals of the detectors 1, 2 and 3 respectively which lie within the pass-bands of the filters 6A, 6B and 6C.

The quantities $S_{1a}$ and $S_{1b}$ are applied to respective inputs of both a digital correlator 13 and a digital adder 14. Adder 14 is constructed to produce output quantities equal to half the sum of each pair of input quantities i.e. to their average value. The quantities $S_2$ are fed to one input of a digital correlator 15 the other input of which is fed with the output quantities of the adder 14. The output quantities A of the correlator 13 are fed to one input of a digital quotient-forming circuit 16 after a constant value has been subtracted from each in a digital subtractor 17. The output quantities B of the correlator 15 are fed to the other input of the circuit 16. Circuit 16 therefore generates a succession of quantities (A–C)/B, where C is a constant. These quantities are subjected to a threshold $V_{ref2}$ in a threshold-responsive circuit 18. The output quantities A of correlator 13 are subjected to a threshold $V_{ref1}$ in a threshold-responsive circuit 19. The output signals of the circuits 18 and 19 are fed to respective inputs of an AND-gate 20 which therefore generates a logic "1" signal at its output 21 if and only if the thresholds $V_{ref}$ and $V_{ref2}$ are exceeded in the circuits 19 and 18 respectively.

The correlators 13 and 15 each operate in a conventional manner. More particularly each multiplies the successive pairs of samples applied to its two inputs by each other and accumulates the results. When n results have been accumulated the accumulation result is generated in the correlator output, after which the accumulator is reset and the process is recommenced. Alternatively the correlators 13 and 15 could be arranged to perform a running correlation.

Neglecting for the moment the threshold-responsive circuit 19 and AND-gate 20 it will be seen that the successive quantities (A–C) obtained by cross-correlating digitized a.c. components of the detectors 1 and 3 in correlator 13 and subtracting the constant C from the results in subtractor 17 are subjected to the threshold $V_{ref2}$ in circuit 18 after being divided by the corresponding quantities B in quotient-forming circuit 16. In other words the successive quantities (A–C) are subjected to successive thresholds $BV_{ref2}$. These thresholds vary, as each depends upon the corresponding quantity B. Each quantity B is obtained by cross-correlating in correlator 15 the digitized a.c. component of the output signal of detector 2 with the sum of the cross-correlated digitized a.c. components of the output signals of the detectors 1 and 3. Thus, the greater the similarity is between the variations with time of the output signal of detector 2 and the output signals of detectors 1 and 3 the greater will be the quantities B and hence the higher will be the thresholds to which the quantities (A–C) are subjected. This assists the apparatus in discriminating against black body radiation which, by chance, varies at a flame flicker frequency; such radiation will give rise to large values of the quantities B.

The threshold-responsive circuit 19 and AND-gate 20 are provided to obtain improved discrimination against the effects of noise in the output signals of the detectors 1 and 3. Only if both the threshold of the circuit 18 is exceeded by the output of quotient-forming circuit 16 and the threshold of the circuit 19 is exceeded by the signal A will AND-gate 20 generate a logic "1" signal at an output 21 indicating the presence of a fire.

It will be evident that many modifications may be made to the embodiment described within the scope of the invention as defined by the claims. For example the detector 3 and the components 4C, 5C, 6C, 7C, 9C, 10C, 11C and 12C may be omitted, correlator 13 and adder 14 then being replaced by a direct connection from the output of multipliers 10A to subtractor 17, circuit 19, and correlator 15. Alternatively or in addition the input quantities to correlator 15 derived from the detectors 1 and 3 may be derived instead from a further detector or detectors (not shown). Such a further detector or detectors may or may not be responsive to the same spectral band as the detectors 1 and 3; they may be responsive to a different spectral band which includes a wavelength characteristic of a fire, for example 2.7 microns. (It will be appreciated that, in any case, the wavelengths of 4.3 microns and 3.8 microns quoted as those to which the detectors 1 and 3, and detector 2 respectively, respond are themselves only examples). Alternatively or in addition the threshold circuit 19 and AND-gate 20 may be omitted, the apparatus output then being derived directly from the circuit 18.

Although the degree of similarity between the variations with time of the output signals of detectors 1 and 3 with the variations with time of the output signal of detector 2 has been described as being determined by cross-correlation (in correlator 15) other ways of determining this similarity may alternatively be employed. For example the positions of turning points or zero crossings in the a.c. components of the signals may be recorded and compared, or their frequency components may be determined and compared.

Although as described the threshold to which the signal A is subjected is varied by dividing the quantities (A–C) by the variable quantities B, alternative ways of achieving this variation may be used. For example the differences between the quantities A and B may be determined and the results subjected to a fixed threshold which may or may not be zero. If this threshold is zero the relevant operations will correspond to direct comparison of the quantities A and B.

Although as described the thresholds to which the quantities A are subjected are functions only of the quantities B they may, if desired, also be made functions of other quantities. For example, it may be arranged that they are also functions of recent signals generated by the detectors 1, 2 and 3. If this is the case it can be arranged that the presence of significant levels of externally generated interference radiation leads to changes in the threshold such as to maintain a substantially constant sensitivity to the presence of a fire.

Some of all of the operations performed by the apparatus shown in the drawing on the output signals of the detectors 1, 2 and 3 may be performed in software.

We claim:

1. A method of detecting the presence of a fire, comprising determining whether a quantity derived from the output of a first detector for radiation within a spectral band which includes a wavelength characteristic of a fire exceeds a threshold which is varied in dependence upon the output signal of a second detector for radiation within a spectral band of wavelengths characteristic of black body radiation, characterized in that the threshold is varied in accordance with the degree of similarity between variation with time of the output signal of the second detector and variation with time of the output signal of said first detector in such manner that the threshold is increased with increasing similarity and decreased with decreasing similarity.

2. A method as claimed in claim 1 wherein the degree of similarity is determined by cross-correlating a.c. components of the two output signals.

3. A method as claimed in claim 2, wherein said a.c. components are those which lie within a frequency band corresponding to flame flicker frequencies.

4. A method as claimed in claim 1, wherein the detection of the exceeding of the threshold is achieved by comparing with a reference value the quotient of said quantity and a second quantity which is dependent upon said degree of similarity.

5. A method as claimed in claim 1, wherein a signal indicative of the presence of a fire is generated if the quantity exceeds both said threshold and a further fixed threshold.

6. A method of detecting the presence of a fire, comprising determining whether a quantity derived from the output of a first detector for radiation within a spectral band which includes a wavelength characteristic of a fire exceeds a threshold which is varied in dependence upon the output signal of a second detector for radiation within a spectral band of wavelengths characteristic of black body radiation, characterized in that the threshold is varied in accordance with the degree of similarity between variation with time of the output signal of the second detector and variation with time of the output signal of a detector for radiation within a spectral band which includes a wavelength characteristic of a fire in such manner that the threshold is increased with increasing similarity and decreased with decreasing similarity and in that the quotient of the amount by which a signal derived from the output of the first detector exceeds a non-zero value and a quantity which is dependent upon said degree of similarity is compared with a reference value.

7. Fire detection apparatus comprising a first detector for radiation within a spectral band which includes a wavelength characteristic of a fire, a second detector for a spectral band of wavelengths characteristic of black body radiation, and a signal processor arranged to determine whether a quantity derived from the output of the first detector exceeds a threshold and to vary said threshold in dependence upon the output signal of the second detector, characterized in that the signal processor is arranged to vary the threshold in accordance with the degree of similarity between variation with time of the output signal of the second detector and variation with time of the output signal of said first detector in such manner that the threshold is increased with increasing similarity and decreased with decreasing similarity.

8. Apparatus as claimed in claim 7, wherein the signal processor includes cross-correlator means arranged to cross-correlate a.c. components of the two output signals to thereby determine said degree of similarity.

9. Apparatus as claimed in claim 7, wherein the signal processor includes quotient determining means for determining the quotient of said quantity and a quantity which is dependant upon said degree of similarity, and threshold-responsive means arranged to compare quotients determined by the quotient-determining means with a reference value.

10. Apparatus as claimed in claim 7, including signal generator means arranged to generate a signal indicative of the presence of a fire if the quantity exceeds both said threshold and a further fixed threshold.

* * * * *